United States Patent [19]

Schilz

[11] 4,230,303

[45] Oct. 28, 1980

[54] STAY NAIL BAR

[76] Inventor: Duane K. Schilz, 3351 W. 8th, Wichita, Kans. 67203

[21] Appl. No.: 82,609

[22] Filed: Oct. 9, 1979

[51] Int. Cl.[3] ..... A47G 27/04

[52] U.S. Cl. ..... 254/212

[58] Field of Search ..... 254/57-63

[56] References Cited

U.S. PATENT DOCUMENTS

| | | | |
|---|---|---|---|
| 761,127 | 5/1904 | Andres | 254/60 |
| 888,689 | 5/1908 | Bradbury | 254/63 |
| 3,022,979 | 2/1962 | Dahlke | 254/62 |
| 3,300,181 | 1/1967 | Spann . | |
| 3,945,609 | 3/1976 | Platek | 254/60 |

*Primary Examiner*—Robert C. Watson

*Attorney, Agent, or Firm*—John H. Widdowson

[57] ABSTRACT

A stay nail bar having a first member mating with a second member, wall abutting blocks attached to an end of each member, and a lever assembly for locking the first member with the second member to flush the wall abutting blocks against the door jams. Two prong receiving bars are connected to the members and include a plurality of operative prongs to engage a carpet to hold it in place while stretching the same.

10 Claims, 6 Drawing Figures

STAY NAIL BAR

BACKGROUND OF THE INVENTION

1. Field of the Invention

This invention is related to a carpet engager. More specifically, this invention provides for a stay nail holder which steadfastly engages a carpet while it is being stretched.

2. Description of the Prior Art

U.S. Pat. No. 3,300,181 by Spann discloses a carpet tool having a single throw lever and a pair of carpet gripping sections that engage the carpet on opposite sides of a seam so that upon moving a lever the carpet sections will be drawn together. U.S. Pat. No. 3,945,609 by Platek discloses an arrangement for drawing the seams of a carpet together wherein the device is really an attachment for the usual type carpet stretchers that are impacted by an operator's knee. None of the foregoing prior art disclose the particular embodiment of this invention.

SUMMARY OF THE INVENTION

This invention accomplishes its desired objects by providing a stay nail bar comprising a first member, a first wall abutting block attached to an end of the first member, and an adjustable bracket means slidably attached to the first member at a predetermined location on the first member. A second tubular member slidably mates with the first member for telescoping movement of the second tubular member along the exterior surface of the first member. A second wall abutting block attaches to an end of the second tubular member and a lever member pivotally attaches to the adjustable bracket means. A lever link pivotally attaches to the lever member and to the second tubular member such as movement of the lever member around the pivotation point with the first member causes telescoping movement of the second tubular member along the exterior surface of the first member. A first prong receiving bar connects to the first member and downwardly extends therefrom; it includes a section in general parallel relationship with the first member. A second prong receiving bar connects to the second tubular member and downwardly extends therefrom and includes a section in generally parallel relationship with the second tubular member. A plurality of operative prongs are attached to the sections of the first prong receiving bar and the second prong receiving which are in parallel relationship with the first member and second tubular member, respectively, to hold a carpet steadfastly in place while stretching same.

It is an object of the invention to provide a novel stay nail bar which is capable of easy operation.

Still further objects of the invention reside in the provision of a stay nail bar which can be easily disassembled and stored, and is relatively inexpensive to manufacture.

These together with the various ancillary objects and features will become apparent as the following description proceeds, are attained by this stay nail bar, a preferred embodiment being shown in the accompanying drawings, by way of example only, wherein:

DETAILED DESCRIPTION OF THE INVENTION

Figure 1:
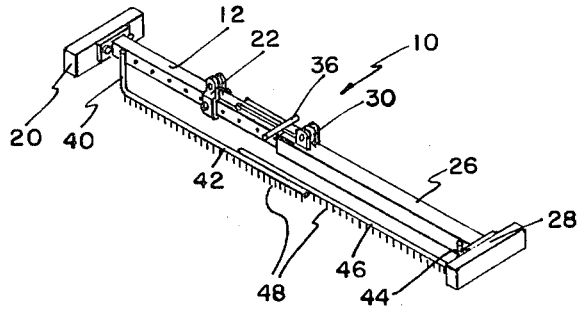
FIG. 1 is a perspective view of the invention.

Referring in detail now to the drawings, wherein similar parts of the invention are identified by like reference numerals, there is seen an embodiment of the invention, generally illustrated as 10, having a first tubular member 12 having a structure defined by a plurality of apertures 14 traversing opposite longitudinal sides of first tubular member 12 such as to have opposed apertures 14 in registry. A first wall abutting block 16 attaches to an end of the member 12 by bolts 18. A first cushion means 20 attaches to the first wall abutting block 16. Adjustable bracket means 22 is slidably attached to first member 12 at a predetermined location on the first member 12. A pin 24 is removably lodged and secured within a pair of opposed apertures 14 for connecting the bracket 22 to the first tubular member 12. A second tubular member 26 slidably mates with the first tubular member 12 for telescoping movement of the second tubular member 26 along the exterior surface of the first tubular member 12. A second wall abutting block (not visible in drawings) is attached to an end of the second tubular member 26 and is enclosed by a second cushion means 28. A lug 30 is attached to the second tubular member 26. A lever member 32 is pivotably attached to the bracket 22 at 34. A T-shaped handle lever 36 is attached to lever member 32. A bifurcated lever link 38 pivotally attaches to the lever member 32 in proximity to its mid-point (as seen in FIG. 2), and pivotally connects to the lug 30.

A first prong receiving bar 40 connects to the first tubular member 12 and downwardly extends therefrom and includes a section 42 which is generally parallel to the first tubular member 12. A second prong receiving bar 44 connects to the second tubular member 26 on the same side as first prong receiving bar 40, and downwardly extends therefrom and has a section 46 which is parallel to the second tubular member 26. A portion of section 42 is juxtaposed to a portion of section 46, and plurality of operative prongs 48 is attached to sections 42 and 46 to hold a carpet (not seen in the drawings) steadfastly in place while stretching same.

Figure 2:
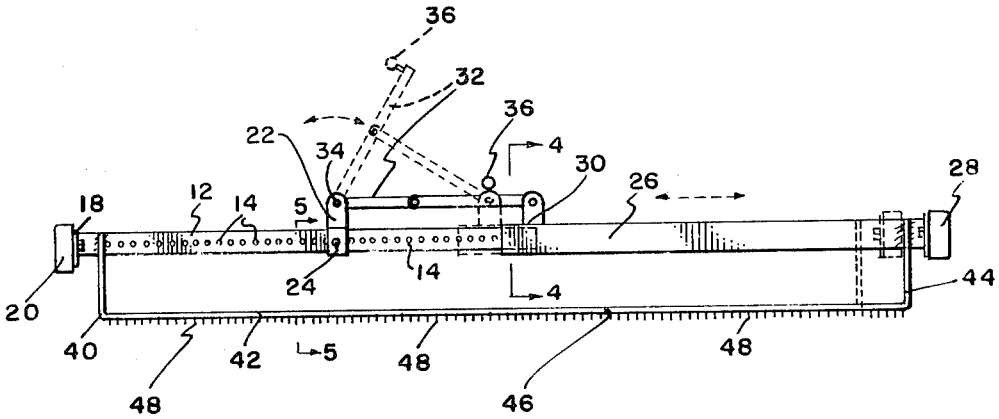
FIG. 2 is a front elevational view of the invention.
Figure 3:
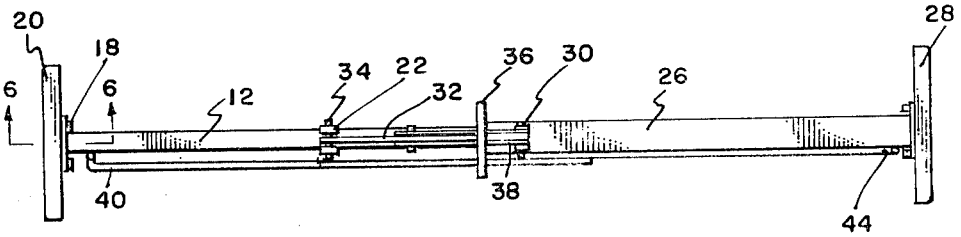
FIG. 3 is a top plan view of the invention.
Figure 4:
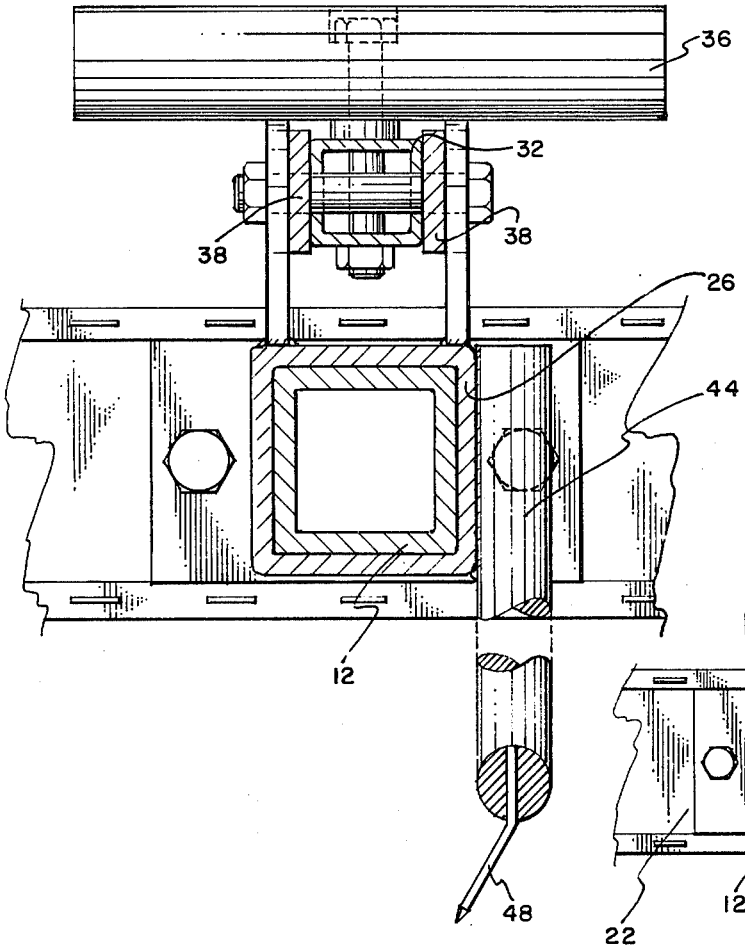
FIG. 4 is an enlarged vertical sectional view looking along the plane of line 4—4 in FIG. 2.
Figure 5:
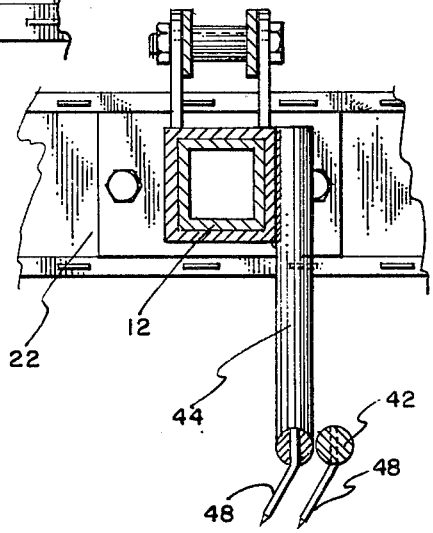
FIG. 5 is a partial enlarged vertical sectional view taken along the plane of line 5—5 in FIG. 2.
Figure 6:
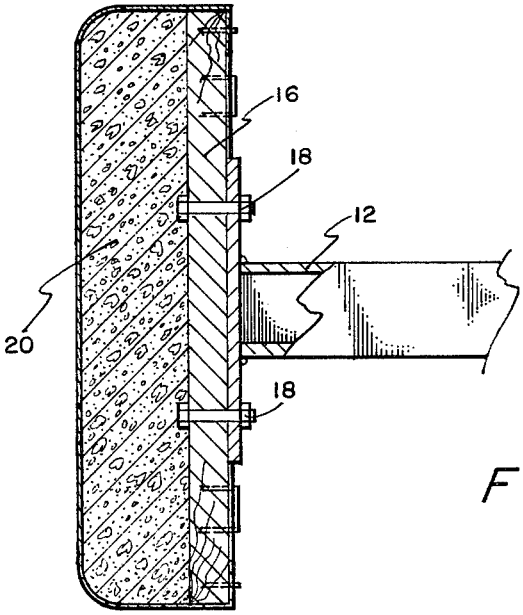
FIG. 6 is a partial exploded vertical sectional view looking along the plane of line 6—6 in FIG. 3.

With continuing reference to the drawings for operation of the invention, adjustable bracket 22 is situated by use of pin 24 in the appropriate pair of opposed apertures 14 such that when the stay nail bar 10 is placed between door jams or a hallway, it can be locked into a closed position by lowering lever member 32 as represented in FIG. 2. Operative prongs 48 engage the carpet along the door sill to maintain same in stretched condition during seaming and/or laying and stretching the carpet in another room.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A stay nail bar comprising a first member, a first wall abutting block attached to an end of said first member, adjustable bracket means slidably attached to said first member for positioning said bracket means at a predetermined location on said first member, a second tubular member slidably mating with said first member for telescoping movement of said second tubular member along the exterior surface of said first member, a second wall abutting block attached to an end of said second tubular member, a lever member pivotally attached to said adjustable bracket means, a lever link pivotally attaching to said lever member and to said second tubular member such as movement of said lever member around the pivotation point with said first member causes telescoping movement of said second tubular member along the exterior surface of said first member, a first prong receiving bar connected to said first member and downwardly extending therefrom and including a section in generally parallel relationship with said first member, a second prong receiving bar connected to said second tubular member and downwardly extending therefrom and including a section in generally parallel relationship with said second tubular member, a plurality of operative prongs attached to the section of the first prong receiving bar and second prong receiving bar in parallel relationship with the first member and second tubular member, respectively, to hold a carpet steadfastly in place while stretching same.

2. The stay nail bar of claim 1 additionally including a lug means attached to said second tubular member, said lever link pivotally connected to said lug means.

3. The stay nail bar of claim 2 wherein said first member is tubular and includes a structure defined by a plurality of apertures traversing opposite longitudinal sides such as to have opposed apertures in registry.

4. The stay nail bar of claim 1 additionally including a first cushion means attached to said first wall abutting block.

5. The stay nail bar of claim 3 additionally including a pin means removably lodging and secured within a pair of said opposed apertures for connecting said bracket means to said first tubular member.

6. The stay nail bar of claim 5 wherein said first prong receiving bar and said second prong receiving bar are respectively attached on the same side of the first member and second tubular member, said section of said first prong receiving bar and said section of said second prong receiving bar in respective parallel relationship with said first member and said second tubular member are juxtaposed with respect to each other.

7. The stay nail bar of claim 6 wherein said lever link is bifurcated into two parts such as to removably receive and lodge said lever member between said parts.

8. The stay nail bar of claim 7 wherein said lever link pivotally attaches to said lever member in proximity to the mid point of the length of said lever member.

9. The stay nail bar of claim 8 additionally including a T-shaped handle lever attached to said lever member.

10. The stay nail bar of claim 4 additionally including a second cushion means attached to the second wall abutting block.

* * * * *